US008647802B2

(12) United States Patent
Higuchi et al.

(10) Patent No.: US 8,647,802 B2
(45) Date of Patent: Feb. 11, 2014

(54) TONER FOR DEVELOPING LATENT ELECTROSTATIC IMAGE, METHOD FOR MANUFACTURING THE SAME, IMAGE FORMING METHOD AND IMAGE FORMING APPARATUS

(75) Inventors: Shinzo Higuchi, Numazu (JP); Hiroshi Takahashi, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 1004 days.

(21) Appl. No.: 12/043,627

(22) Filed: Mar. 6, 2008

(65) Prior Publication Data

US 2008/0220348 A1 Sep. 11, 2008

(30) Foreign Application Priority Data

Mar. 7, 2007 (JP) ..... 2007-056649

(51) Int. Cl.
*G03G 9/00* (2006.01)

(52) U.S. Cl.
USPC ..... 430/110.4; 430/137.1; 430/110.1; 430/137.22

(58) Field of Classification Search
USPC ..... 430/137.1, 137.14, 110.1–110.4
See application file for complete search history.

(56) References Cited

U.S. PATENT DOCUMENTS 4,835,084 A * 5/1989 Nair et al. ..... 430/137.1
6,001,528 A 12/1999 Nagai et al.
2003/0027066 A1 2/2003 Yamashita et al.
2006/0063089 A1 3/2006 Tanaka et al.
2006/0099529 A1* 5/2006 Tanaka et al. ..... 430/137.14
2006/0154164 A1* 7/2006 Kidokoro ..... 430/108.23
2006/0216629 A1 9/2006 Miyakawa et al.
2008/0166648 A1* 7/2008 Veregin et al. ..... 430/108.6

FOREIGN PATENT DOCUMENTS

JP 2000-321821 11/2000
JP 2001-125309 5/2001
JP 2002-91071 3/2002
JP 2005173017 A * 6/2005
JP 2006-64966 3/2006

OTHER PUBLICATIONS

English translation of JP 2005-173017, Jun. 2005, Matsuoka et al.*

* cited by examiner

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

To provide a toner manufacturing method including: continuously mixing an oil phase with an aqueous phase to form an emulsified liquid using an emulsifying mechanism having an emulsified liquid circulation pathway and an emulsifying device equipped with a stirring blade; forming liquid droplets from the emulsified liquid by controlling the equilibrium between atomization and integration of the liquid droplets; and feeding the liquid droplets with stirring to a series of treatments including at least desolvation, filtration, washing and drying; wherein a product T of the solid content concentration (% by mass) of the oil phase and viscosity (mPa·s) measured with a rotating viscometer at 25° C., and 6 rpm satisfies $30{,}000 \leq T \leq 50{,}000$.

17 Claims, 1 Drawing Sheet

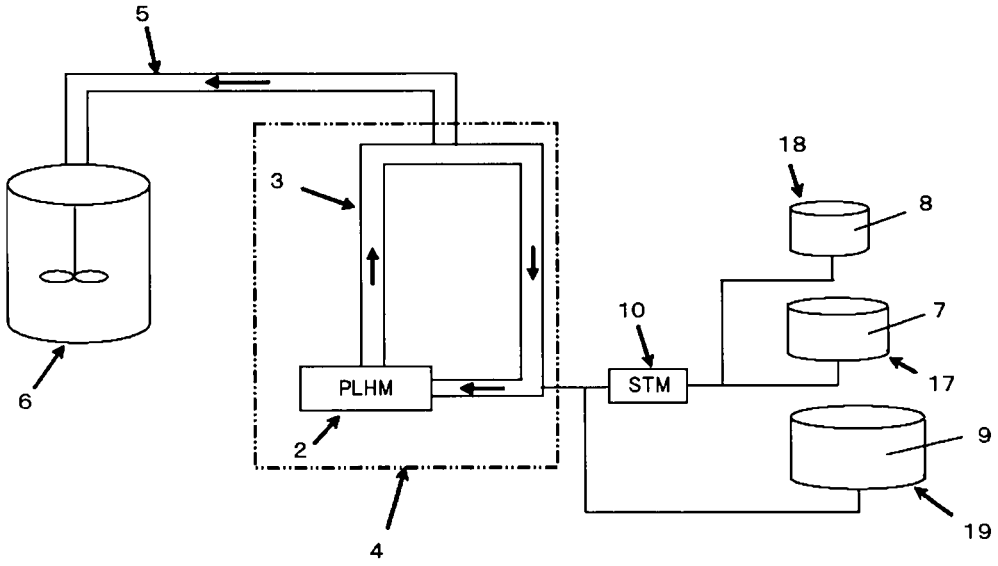
5
3
18
8
10
7
PLHM
STM
17
6
2
9
4
19

TONER FOR DEVELOPING LATENT ELECTROSTATIC IMAGE, METHOD FOR MANUFACTURING THE SAME, IMAGE FORMING METHOD AND IMAGE FORMING APPARATUS

BACKGROUND OF THE INVENTION

1. Field of the Invention

The present invention relates to a toner technology used for electricphotography, electrostatic records and electrostatic printing, more particularly to a method for manufacturing toner that has a stable particle size and a sharp particle size distribution, a toner manufactured using the method, an image forming method and image forming apparatus using the toner.

2. Description of the Related Art

A developer used for electrophotography, electrostatic recording and electrostatic printing is once attached to, for example, an image bearing member such as a photoconductor having a latent electrostatic image formed thereon in a developing step, then the image is transferred from the photoconductor to a transfer medium such as transfer paper in a transfer step, thereafter the image is fixed onto a paper surface in a fixing step.

Developers used for developing latent electrostatic images formed on latent electrostatic image-bearing surfaces of photoconductors are of two types: a two-component developer composed of carrier and toner, and a one-component developer composed of magnetic or non-magnetic toner requiring no carriers. These developers are known as dry toners. As the dry toner used for these electric photography, electrostatic recording and electrostatic printing purposes, those toners have been used that are prepared by melt-kneading toner binder, such as styrene based resin or polyester based resin, together with colorant and by finely pulverizing the resulting kneaded product.

Generally, a method for reducing the particle diameter of toner is employed for improving image quality in order to obtain high-definition and high quality images.

However, phenomena have occurred in such that the toner is further pulverized and thereby extremely fine particles are generated and/or image quality becomes deteriorated since fluidizer is embedded on the toner surface because of 1) an irregular particle shape of the toner to be obtained in case of using a manufacturing method according to a normal kneading and pulverizing method, 2) stress stirred with the carriers in the developing unit of an image forming apparatus in case of using the dry toner as a two-component developer, or 3) stress in contact with a developing roller, a toner supply roller, a layer thickness regulating blade, and a frictional electrification blade in case of using the same as a one-component developer.

A toner with an irregular particle shape is an obstruction factor for downsizing the apparatus since its fluidity is so poor as a powder that necessity of increasing fluidization is generated, or the fill up rate of a toner bottle with toner is low. Therefore, an advantage of a reduced particle diameter cannot be effectively provided now. A problem arises in manufacturing toner particles by means of a pulverizing method: There is a limitation as to an obtainable particle diameter and thus further downsizing of particle diameter cannot be effected.

In order to cover defects caused by such irregular particle shapes, various methods for manufacturing spherical toner are proposed. For example, methods generally used include a polymer suspension method and an emulsion method. Such manufacturing methods include a step of emulsifying an oil phase, which has been prepared by dissolving or dispersing colorant (e.g., resin and pigment) and toner components (e.g., wax) into an organic solvent (including monomer), by mixing it with an aqueous phase by means of a mechanical emulsifying means to form toner particle-sized liquid droplets.

In case of using a toner manufactured by a suspension method or an emulsion method, the emulsified liquid generates liquid droplets while repeating the equilibrium reaction between atomization by shearing and integration of atomized particles, and the size of the particle diameter and the particle size distribution is temporarily determined when balance of the atomization and coalescence are kept.

As a major factor by which the size of the toner particle diameter and the particle size distribution are determined in this case, considered are energy at the time of shearing; the energy is given to the raw materials supplied by an emulsion machine, and total shearing energy per feed unit flow rate of raw materials; the total shearing energy is given during equilibrium reaction between atomization of particles by shearing and integration of the atomized particles.

However, problems have arisen that differences occur between particle diameter (volume average particle diameter) and particle size distribution during the emulsifying step because different toner formulations offer different equilibrium rates between atomization by shearing and integration of the atomized particles, and as such optimal conditions cannot be obtained. Although a method is used in order to deal with these problems for adjusting the volume average particle diameter of toner and the particle size distribution and aligning them to the target values as a post-step, including the step of cutting dust-sized particles and rough-sized particles, problems have arisen including complicated manufacturing steps with longer amount of time required and the worsening of efficiency.

As a method for improving the size of toner particles and the particle size distribution, the following methods are discussed.

For example, a method is discussed for manufacturing a toner with no variation of performance between the sharp particle size distribution and the particles by means of using a stirring layer equipped with stirring blades in the upper, lower and adjacent positions; including the stirring blades in the upper position provided antecedent to a rotating direction at an intersection angle less than ninety degrees to the stirring blades in the lower position. (Refer to Japanese Patent Application Laid-Open (JP-A) 2000-321821 for example.)

A method is also discussed for manufacturing a polymerization toner that provides sharp particle size distributions after the polymerization by means of controlling blade tip speed during polymerization reaction, depth of the stirring blade mounted on the top from the water surface, and stirring power requirement during the polymerization into a specific range (see JP-A No. 2001-125309, for example).

Another method is discussed for effectively manufacturing a toner that has a sharp particle size distribution by means of setting relations between volumes V ($m^3$) of fluid materials present in a granulation vessel and applied motive power P (kW) of the stirring apparatus into $15<P/V<100$. (Refer to JP-A No. 2002-91071, for example.)

The above described methods control shapes, arrangement and stirring power of the stirring blades and form the toner particles as the target values; however, it is difficult to mention that these methods granulate with the consideration of coalescence behavior acquired as an important factor of the granulating mechanism according to so-called the present invention as described below. In other words, these methods control the toner particles without considering the equilibrium between atomization of toner particles by shearing power and integration of atomized particles. Therefore, these methods are insufficient for manufacturing a toner that has further stable particle diameter and sharp particle size distribution.

BRIEF SUMMARY OF THE INVENTION

In light of the above related art, the present invention is directed to a method for manufacturing a toner that has stable particle diameters (volume average particle diameters) and a sharp diameter size distribution, a toner capable of faithfully developing latent electrostatic images obtained by the manufacturing method and reproducing high quality full-color images, an image forming method using the same, process cartridges and an image forming apparatus.

As a result of keen examination, the inventors of the present invention have found out that the above problems are solved when a toner is obtained that has stable particle diameters and a sharp particle size distribution by means of preferably controlling a shearing condition of atomization and an integration condition of fine particles at the step of emulsifying oil phase and the aqueous phase in case of manufacturing a toner with fine particle diameter according to an emulsion method, and thus reached the present invention.

More specifically, the present invention is as follows.

<1> A method for manufacturing a toner for developing a latent electrostatic image, including: continuously mixing an oil phase with an aqueous phase to form an emulsified liquid by use of an emulsifying mechanism having an emulsified liquid circulation pathway and an emulsifying device equipped with a stirring blade; forming liquid droplets from the emulsified liquid by controlling the equilibrium between atomization and integration of the liquid droplets; and feeding the liquid droplets with stirring to a series of treatments including at least desolvation, filtration, washing and drying; wherein the oil phase is at least one of a dissolved matter and dispersion in which at least a resin and/or resin precursor, a colorant and a releasing agent are dissolved or dispersed into an organic solvent, and wherein a product T of the solid content concentration (% by mass) of the oil phase and viscosity (mPa·s) measured with a rotating viscometer at 25° C., and 6 rpm satisfies $30{,}000 \leq T \leq 50{,}000$.

<2> The method for manufacturing a toner for developing a latent electrostatic image according to <1>, wherein a basis substance is added in the emulsified liquid in an amount of 200 ppm to 400 ppm.

<3> The method for manufacturing a toner for developing a latent electrostatic image according to one of <1> and <2>, wherein the resin or resin precursor is composed of two or more different polymers with different molecular weights.

<4> The method for manufacturing a toner for developing a latent electrostatic image according to any one of <1> to <3>, wherein the polymers with different molecular weights are composed of a modified polyester resin modified by a urea bond and a non-modified polyester resin not modified by a urea bond.

<5> The method for manufacturing a toner for developing a latent electrostatic image according to any one of <1> to <4>, wherein the aqueous phase is an aqueous medium containing a solid fine particle dispersing agent.

<6> The method for manufacturing a toner for developing a latent electrostatic image according to any one of <1> to <5>, wherein the weight ratio between the oil phase and the aqueous phase in the emulsified liquid is between 60:40 and 20:80.

<7> The method for manufacturing a toner for developing a latent electrostatic image according to any one <1> to <6>, wherein upon stirring the blade circumferential speed is between 0.4 m/sec and 1 m/sec.

<8> A toner produced by the method according to any one of <1> to <6>, wherein the toner has a volume-average volume particle diameter of 3 μm to 8 μm.

<9> A toner produced by the method according to any one of <1> to <6>, wherein the ratio of the volume-average particle diameter (Dv) to number-average particle diameter (Dn) of the toner is 1.05 and 1.25.

<10> Am image forming method including: developing a latent electrostatic image formed on a photoconductor by use of a toner to form a toner image; transferring the toner image to a recording medium; and fixing the toner image to the recording medium, wherein the toner is the toner according to one of <8> and <9>.

<11> A process cartridge including: a photoconductor; and at least one unit selected from a charging unit, a developing unit containing therein a developer, and a cleaning unit, the process cartridge detachably amounted to a main body of an image forming apparatus, wherein the toner is the toner according to one of <8> and <9>.

<12> An image forming apparatus including: a process cartridge detachably mounted to a main body of the image forming apparatus, wherein the process cartridge is the process cartridge according to <11>.

With the toner manufacturing method of the present invention, both the condition of particle atomization by shearing power and the condition of particle integration are suitably controlled in the step of mixing an oil phase including toner components and with an aqueous phase containing a solid fine particle dispersing agent, whereby the balance of atomization and integration is kept and a toner that has intended particle diameters (volume-average particle diameter) with a sharp distribution can be effectively manufactured. According to the manufacturing method of the present invention, a toner for developing a latent electrostatic image can be obtained; the toner is capable of faithfully developing latent images and reproducing high quality full-color images. Using such a toner allows an image forming method, process cartridges and an image forming apparatus obtaining high definition and high quality images to be provided.

BRIEF DESCRIPTION OF SEVERAL VIEWS OF THE DRAWINGS

FIG. 1 is an outline configuration diagram showing an example of a granulating apparatus used in an emulsifying step for manufacturing a toner according to the present invention.

DETAILED DESCRIPTION OF THE INVENTION (Toner and Manufacturing Method Thereof)

The toner manufacturing method according to the present invention includes at least 1) a step of preparing an emulsion solution by continuously mixing an oil phase with an aqueous phase which is an aqueous medium containing a solid fine particle dispersing agent, the oil phase prepared by dissolving or dispersing into an organic solvent two or more resins with different molecular parts (e.g., modified polyester resins modified by urea bonds, and non-modified polyester resins not modified by urea bonds), colorant, releasing agents, and 2) the step of controlling the equilibrium between atomization and integration to form liquid droplets. This methods implements effective manufacturing of a toner that has a stable average volume particle diameter as well as sharp particle size distribution by means of preferably controlling both solid content concentrations of the above oil phase and viscosity.

A toner according to the present invention can be obtained by a toner manufacturing method according to the present invention.

Description of the toner manufacturing method according to the present invention is disclosed as follows:

FIG. 1 illustrates an outline configuration diagram as an example of a granulating apparatus used in an emulsifying step for manufacturing a toner according to the present invention. In FIG. 1, an emulsifying mechanism 4 is adapted to an emulsifier (PLHM) 2 and an emulsified liquid circulation pathway 3. More specifically, oil phases 7 and 8, and a aqueous phase 9 are mixed at the emulsifying mechanism 4; the oil phases and the aqueous phase are supplied from each supplying layer (A-type oil phase supplying layer 17, B-type oil phase supplying layer 18, and a aqueous phase supplying layer 19), and toner-sized liquid droplets are generated, with the equilibrium reaction between atomization granted by shearing power (hereinafter referred to as the atomization by shearing in some cases) and integration of fine particles repeated. The oil phase herein is a dissolved matter or dispersion made of an organic phase containing at least resin, resin precursor or monomer (e.g., dissolved matter in which resin, colorant and releasing agent are dissolved into an organic solvent, or a dispersion in which they are dispersed in an organic solvent), while the aqueous phase herein is an aqueous medium containing a solid fine particle dispersing agent.

Although the oil phase may include resin, resin precursor or monomer, it is appropriate to use two or more different types of polymers with different molecular parts; for example, as a resin or a resin precursor in order to obtain a well-balanced property. As such polymers, it is particularly preferred to employ polyesters resin that can provide good full-color image reproducibility. As a polyester resin, it is preferred to prepare a composition consisting of two or more different types of resins by use of modified polyester resins modified by urea bond and non-modified polyester resins not modified by urea bond, because by so doing the balance of low-temperature fixing properties, heat resistance/storage stability and anti-hot offset properties can be kept. These resins are described below. As a toner component according to the present invention, it is possible to use resins, such as a styrene acrylic resin and a polyol resin; the resins are generally used for a toner.

As a toner component according to the manufacturing method of the present invention, the cases of using modified polyester resins and non-modified polyester resins are described as examples.

An embodiment in FIG. 1 shows an example that toner components in resin materials are separated and supplied as A-type oil phase 7 and B-type oil phase 8.

The A-type oil 7 hereof is a solution produced by means of mixing a dissolved matter or dispersion liquid, prepared by dissolving or dispersing resin (e.g., non-modified polyester resin), colorant and releasing agent into an organic solvent, with an extender (e.g., an active hydrogen component that undergoes additional reaction with a prepolymer of B-type oil phase 8). The B-type oil phase 8 is a solution in which a prepolymer having isocyanate bonds is dissolved in an organic solvent. The aqueous phase 9 is an aqueous medium that includes a solid fine particle dispersing agent (for example, a solid resin fine particle dispersing agent). Details of the oil phase components and the aqueous phase components are described as below.

The above A-type oil phase 7 and the B-type oil phase 8 are previously stirred by a static mixer (STM) 10 before these phases are mixed with the aqueous phase 9. Herein, the liquid after being previously stirred is referred to as the oil phase. The oil phase mixed by the STM 10 and the oil phase 9 are continuously fed to an emulsifying mechanism 4 at predetermined quantities, and these phases are emulsified with shearing power applied while they are being stirred by an emulsifier (PLHM) 2 mounted in an emulsified liquid circulation pathway 3. PLHM herein is an abbreviation of a pipeline homomixer. The emulsified liquid is then converted into preferable toner-sized liquid droplets through circulation and accumulation in the emulsified liquid circulation pathway 3, and then discharged to a transfer pipe 5 and fed to a stirring tank 6.

As described before, it is necessary to control atomization granted by shearing and integration of the atomized particles in order to obtain a toner having a stable small particle diameter and a sharp particle size distribution. In other words, it is demanded to preferably regulate both the condition of atomization and the condition of integration. These are described in the order as follows:

[Atomization]

When an emulsifier applies shearing power to the oil phase and the aqueous phase, oil droplets occurs in the aqueous phase and these are in so-called an O/W type state. It is necessary to atomize these oil droplets in order to obtain a toner with a uniform, small particle diameter. Factors that greatly influence the oil droplet size include the weight ratio between the oil phase and aqueous phase at the time of emulsification, and the level of shearing power.

The weight ratio between the oil phase and aqueous phase at the time of emulsification is in a range between 60/40 and 20/80, and preferably in a range between 40/80 and 30/70. Where the weight ratio of the oil phase exceeds that range, the distance between oil droplets becomes so short that they easily aggregate together, resulting in a unstable O/W type emulsion. In addition, if the weight ratio of the oil phase is smaller than the above range, the shearing power hardly travels to the oil phase and the shearing power becomes greatly needed. Such a state is not favorable for productivity.

It is necessary to appropriately change shearing power upon emulsification according to the weight ratio of the oil phase to the aqueous phase. Where shearing power is too great, resin components in oil droplet particles are broken, resulting in failure to obtain toner performance of interest. Where shearing power is too small, the particle diameters of oil droplets becomes uneven, so that it is difficult to stably obtain fine particles.

[Integration]

A toner with a sharp particle size distribution can be obtained as a result of integration of evenly atomized oil droplets. A main mechanism of this is the bonding of one particle to another particle with intermolecular force; in other words, smaller particle diameters providing larger surface area becomes more advantageous in integration. Larger particle diameters increases molecular weight and intermolecular force becomes greater, resulting in integration.

It is necessary to proceed integration of fine particles and at the same to prevent further integration of the resulting particles in order to obtain a toner with sharp particle size distribution.

As a result of keen examination, the inventors of the present application have found that surface tension of particles is involved in integration of particles. In other words, larger surface tension of particles provides greater repulsive force when collision between particles occurs, thereby blocking integration of particles.

Although it is actually difficult to measure the above surface tension, both the surface tension and the viscosity are factors strongly affected by interaction between molecules, and they are greatly influenced by solid content concentration; in other words, higher solid content concentration generally induces greater surface tension and viscosity. More specifically, they have found out that surface tension is capable of being substituted by a product T of solid content concentration in the oil phase (percent by weight) and viscosity (mPa·s).

It is possible to effect integration of fine particles and prevent the resulting particles from further being integrated, by setting the above T in a range between $30000 \leq T \leq 50000$, whereby a toner with fine particle diameter and sharp particle size distribution can be stably obtained.

The above T value is preferably between $35000 \leq T \leq 45000$, and more preferably between $37000 \leq T \leq 40000$.

When the above T becomes smaller than 3000, integration of particles develops and coarse particles result, increasing the particle sizes and thereby the particle size distribution becomes broad. When the above T becomes greater than 5000, integration of particles is blocked, and extremely fine particles become present and thus the particle size distribution becomes broad.

(Method for Measuring Viscosity)

The viscosity of the oil phase according to the present invention can be measured with a VDA2 type Vismetron viscometer made by Shibaura Systems Co., Ltd. The viscosity herein indicates a viscosity of sample adjusted to 25° C. in a constant-temperature bath as measured using No. 3 rotor at a rotational speed of 6 rpm.

A blade circumferential speed of emulsified liquid in a stirring tank is preferably in a range between 0.4 and 1 m/sec. When a blade circumferential speed is smaller than 0.4 m/sec, the emulsified liquid is close to a stationary state, wherein bonding force between particles is greater than the repulsive force and the bonding force is prone to become concentrated leading to large particles. When the blade circumferential speed is greater than 1 m/sec, oil droplets collide with each other in a state with great energy, so that integration of particles is promoted, generating aggregates and leading to coarse particles.

The generation of aggregates can be prevented by the addition of basic substance in the stirring tank. This is achieved because the basic substance electrically attached to the toner surface increases the thickness of an electric double layer and thus dispersion stability improves. The dispersion stability also improves even with effects of steric hindrance of the basic substance attached to the toner surface. The added amount of the above basic substance is favorably in a range between 200 ppm and 400 ppm.

When the added amount of the basic substance becomes less than 200 ppm, improvement in the dispersion stability is low and the prevention effects of particle integration are insufficient. When the added amount becomes more than 400 ppm, the thickness of the electric double layer on the toner surface decreases and the dispersion stability reduces, so that particles tend to be integrated leading to coarse particles.

Examples of the above basic substance include metal hydroxides, basic oxides, tertiary amines, secondary amines, and primary amines.

The aforementioned manufacturing method allows atomized particles granted by shearing power and coalescence of the atomized particles to be controlled, so that a toner with a stable fine particle diameter and sharp particle size distribution can be obtained.

[Toner Particle Diameter]

Next, in case of using the aforementioned polyester resin as a toner component, the average volume particle diameter (Dv) of the toner (dry toner) is set in a range between 3 μm and 8 μm, and the value of the average volume particle diameter (Dv) divided by the average number particle diameter (Dn), i.e., Dv/Dn, is set in a range between 1.05 and 1.25, so that developability is excellent in any of the heat resistance/storage stability, low-temperature fixing properties, and anti-hot offset properties; particularly excellent to the gloss property of images when the toner is used for a full-color copier; furthermore, a two-component developer reduces variation of toner particle diameters in the developer, even inflow and outflow of a toner is provided in a long run, and excellent and stable developability can be obtained even at long term stirring in a developing apparatus.

In case of using the polyester based resin as a one-component developer, variations in the toner particle diameter becomes limited and no filming occurs to a developing roller even though inflow and outflow of toner is conducted, and no toner fusion is generated even to members, such as a blade mounted for making the toner layer thin. Using a developing apparatus with a long-term toner stirring, thus, also allows good and stable developability and images to be obtained.

Although it is generally said that a smaller particle diameter of a toner is more advantageous in obtaining images with high resolution and high quality, it is adversely more disadvantageous in obtaining transfer properties and cleaning properties.

In case where the average volume particle diameter is smaller than the range set forth in the present invention, a two-component developer causes a toner to be fused on a carrier surface in long-term stirring in a developing apparatus; in case of using the polyester based resin as a one-component developer, toner filming to a developing roller and a toner fusion to members, such as a blade for making the toner layer thin easily occur. These problems can be solved by means of using below-described resin as a toner component according to the present invention, and applying the above manufacturing method.

It is also considered that a smaller particle diameter of a toner can hardly be affected to a load change owing to viscosity changes of processing liquid, cavitation control during circulation and pressure changes. In case where particle diameter of a toner is conversely greater than the range set forth in the present invention, it is difficult to obtain images with high resolution and high quality, and the particle diameter of toner often changes when inflow and outflow of toner is conducted. It is also found that it is the same in cases where Dv/Dn is greater than 1.25.

(Method for Measuring Particle Size Distribution)

The particle size of the toner (volume average particle diameter) and the particle size distribution of the toner are measured as follows:

As a measuring apparatus, Coulter Multisizer III (made by Coulter, Inc.) is used. It is connected to a personal computer (made by IBM Corp.) and data analysis is conducted with exclusive analysis software (made by Coulter, Inc.). The Kd value is set with standard particles of 10 μm diameter while the aperture current is automatically set. As the electrolyte, 1% NaCl aqueous solution was prepared using primary class sodium chloride. As another electrolyte, ISOTON-11 (made by Coulter Scientific Japan Co., Ltd.) can be used.

Specifically, measurement starts from addition of surfactant as a dispersing agent, preferably 0.1 ml to 5 ml of acrylic benzene sulfonate, into 100 ml and 150 ml of the aqueous electrolyte solution prepared above and further addition of 2 mg to 20 mg of sample. The sample suspended in the electrolyte is then sonicated about 1 to 3 minuets using an ultrasonic dispersing device, and the volume distribution and number distribution are calculated by measuring the volume of 50,000 toner particles of 2 μm or greater in particle diameter using a 100 μm aperture tube. Then, obtained are an average volume particle diameter (Dv) on a volume basis obtained from the volume distribution according to the present invention, and an average number particle diameter (Dn) on a number basis obtained from the number distribution according to the present invention. The particle size distribution is sharper when the value of Dv/Dn is closer to 1.0.

Hereinafter, toner components contained in the oil phase or organic phase in the present invention will be described.

The organic phase can include resin, resin precursor or monomer. Described below is an example of two or more types of polymers with different molecular parts fit for obtaining well-balanced characteristics as the above-described resins or resin precursor; particularly a polyester resin (a combination of modified polyester resins and non-modified polyester resins) are preferred to reproduce full-color images.

(Modified Polyester Resin)

A modified polyester resin is defined as a polyester resin that contains bonds or groups other than ester bonds and functional groups derived from monomer units (acids and alcohols) used as resin sources, or as a polyester resin that contains a resin component that has a different composition from polyester resin and that is bonded to the polyester resin by covalent bonding or ion bonding.

Examples of the modified polyester resin include, for example, resin of which a terminal of a polyester is modified by a bond other than an ester bond. More specific example is a resin prepared by reacting a polyester resin with a compound (e.g., an isocyanate compound) that reacts with an acidic group or hydroxyl group of a terminal of polyester resin to introduce a functional group such as an isocyanate group, and reacting the functional group with an active hydrogen compound, so that the polyester terminal is modified or elongated. Examples of such modified polyester resins include urea-modified polyesters and urethane modified polyesters.

Additional examples include those that contain reactive groups such as double bonds in the polyester main chain, from which radical polymerization occurs to introduce graft components via carbon-carbon single bonds at the chain side or to effect crossslinking of the double bonds. Examples include styrene modified polyesters and acrylic modified polyesters.

Furthermore, examples include those in which a resin component that has a different composition from polyester is copolymerized with the polyester resin main chain, those in which a carboxyl or hydroxyl group is reacted, e.g., those copolymerized with a silicone resin having at its terminal a carboxyl group, hydroxyl group, epoxy base or mercapto group (e.g., silicone modified polyesters). Typical modified polyester resins are specifically described as follows:

(Urea Modified Polyester Resin)

Examples of the polyesters modified by the urea bond (urea modified polyester resins) include (i) reaction products of isocyanate group-containing polyester prepolymers (A) and amines (B).

Examples of the isocyanate group-containing polyester prepolymers (A) include polycondensation products of polyols (1) and polycarboxylic acids (2), as well as active hydrogen group-containing polyesters further reacted with polyisocyanates (3).

Examples of the active hydrogen group that the above polyester has include hydroxyl group (alcoholic hydroxyl group and phenol hydroxyl group), amino group, carboxyl group and mercapto group, with alcoholic hydroxyl group being most preferable.

Examples of the polyols (1) include diols (1-1) and trivalent or more polyols (1-2), and it is preferred to use diols (1-1) singly or to use mixtures of diols(1-1) and a small amount of polyols (1-2).

Examples of the diols (1-1) include alkylene glycols (for example, ethylene glycol, 1,2-propylene glycol, 1,3-propylene glycol, 1,4-butane diol, 1-6-hexyan diol); alkylene ether glycols (for example, diethyl glycol, triethylene glycol, dipropylene glycol, polyethylene glycol, polypropylene glycol, polytetraethylene ether glycol); alicyclic diols (for example, 1-4-cycrohexyan dimethanol, hydrogen added bisphenol A); bisphenols (for example, bisphenol A, bisphenol F, bisphenol S); alkylene oxides (for example, ethylene oxide, propylene oxide, butylene oxide) adducts of the above alicyclic diols; alkylene oxides (for example, ethylene oxide, propylene oxide, butylene oxide) adducts of the above bisphenols.

Among the above, it is preferable to use alkylene glycols of 2 to 12 carbon atoms and alkylene oxide adducts of the bisphenols. It is more preferable to use the alkylene oxide added products of the bisphenols and the alkylene glycols of 2 to 12 carbon atoms in combination.

Examples of the trivalent or more polyols include trivalent to octovalent or more multivalent aliphatic alcohols (for example, glycerine, trimethylol ethane, trimethylol propane, pentaerythritol, sorbitol); trivalent or more phenols (for example, trisphenol PA, phenol novolac, cresol novolac); and alkylene oxide adducts of the above trivalent or more polyphenols.

Examples of the polycarboxylic acids (2) include dicarboxylic acids (2-1) and trivalent or more polycarboxylic acids (2-2), it is preferred to use dicarboxylic acids (2-1) singly or to use mixtures of dicarboxylic acids (2-1) and a small amount of polycarboxylic acids (2-2).

Examples of the dicarboxylic acids (2-1) include alkylene dicarboxylic acids (for example, succinic acid, adipic acid, sebacic acid) alkenylenene dicarboxylic acids (for example, maleic acid, fumaric acid); and aromatic dicarboxylic acids (for example, phthalic acid, isophthalic acid, telephthalic acid, naphthalene dicarboxylic acid). Among them, it is preferred to use alkenylenene dicarboxylic acids with 4 to 20 carbon atoms and aromatic dicarboxylic acids with 8 to 20 carbon atoms.

Examples of the trivalent or more polycarboxylic acids (2-2) include polycarboxylic acids with 9 to 20 carbon atoms (for example, trimellitic acid, pyromellitic acid).

As the polycarboxylic acids (2), acid anhydrides of the above-described or lower alkyl esters (for example, methyl ester, ethyl ester, isopropyl ester) may be used for reacting with polyols (1).

A ratio between polyol (1) and polycarboxylic acid (2) is normally between 2/1 and 1/1, preferably between 1.5/1 and 1/1, and more preferably between 1.3/1 and 1.02/1 as a chemical equivalent ratio [OH]/[COOH] between a hydroxyl group [OH] and a carboxyl group [COOH].

Examples of the polyisocyanates (3) include aliphatic polyisocyanates (for example, tetraethylene diisyanate, hexamethylene diisocyanate, 2,6-diisocyanato caproate); alicyclic polyisocyanates (for example, isoholon diisocyanate, cyclohexylmethane diisocyanate); aromatic diisocyanates (for example, tolylene diisocyanate, diphenylmethane diisocyanate); aromatic aliphatic diisocyanates (for example, α,α,α',α'-tetramethylxylylene diisocyanate); isocyanurates; and the above polyisocyanates blocked with phenol derivative, oxime, caprolactam, etc. These compounds may be used singly or in combination.

A ratio of polyisocyanate (3) is normally between 5/1 and 1/1, preferably between 4/1 and 1.2/1, and more preferably between 2.5/1 and 1.5/1 as a chemical equivalent ratio [NCO]/[OH] between an isocyanate group [NCO] and a polyester hydroxyl group [OH] having a hydroxyl group. In case [NCO]/[OH] exceeds 5/1, the low-temperature fixing property deteriorates. In cases where the chemical equivalent ratio [NCO]/[OH] is less than 1/1, the urea contents in the modified polyester becomes so low that the anti-hot offset property deteriorates.

The amount of polyisocyanate (3) components in the prepolymer (A) having an isocyanate group on its end is normally between 0.5% by weight and 40% by weight, preferably between 1% by weight and 30% by weight, and more preferably between 2% by weight and 20% by weight. Under the content less than 0.5% by weight, the anti-hot offset property deteriorates and it is disadvantageous to combine the heat-resistance-storage stability with the low-temperature fixing property. In case the contents exceed 40% by weight, the low-temperature fixing property deteriorates.

The numbers of isocyanate groups contained per molecular in the isocyanate group-containing prepolymer (A) are normally one or more, preferably between the averages of 1.5 groups and 3 groups, and more preferably between the averages of 1.8 groups and 2.5 groups. In case where the number is less than one per molecular, molecular weight of the urea-modified polyester becomes so low that the hot offset resistance deteriorates.

Examples of the amines (B) include diamines (B1), trivalent or more polyamines (B2), amino alcohols (B3), amino mercaptans (B4), amino acids (B5), and the above (B1) to (B5) amines in which their amino groups are blocked (B6).

Examples of the diamine (B) include aromatic diamines (for example, phenylene diamine, diethyltoluenediamine, 4,4 diamino diphenyl methane); alicyclic amines (for example, 4,4'-diamino-3,3' dimethyl dicychlohexyl methane); and alphatic diamines (for example, ethylene diamine, tetramethylene diamine, hexamethylene diamine).

Examples of the trivalent or more polyamine (B2) include diethylene triamine, and triethylene tetramine. Examples of the amino alcohol (B3) include ethanolamine, and hydroxymethyl aniline. Examples of the amino mercaptan (B4) include amine ethyl mercaptan, and amino propyl captan.

Examples of (B6) include ketimine compounds obtained from the above amines (B1) to (B5) and ketones (for example, acetone, methyl ethyl ketone, and methyl isopropyl ketone), and oxazoline compounds.

Among these amines (B), it is preferred to use (B1) or a mixture of B1 and a small amount of (B2).

It is also possible to adjust the molecular weight of the urea modified polyester resin (i) by use of an elongation terminator as needed. Examples of such an elongation terminator include monoamines (for example, diethylamine, dibutylamine, butylamine, and laurylamine), and those that have blocked them (for example, ketimine compounds).

As the ratio of the amines (B), it is normally between 1/2 and 2/1, preferably between 1.5/1 and 1/1.5, and more preferably between 1.2/1 and 1/1.2 as a chemical equivalent ratio [NCO]/[NHx] between an isocyanate group [NCO] in the prepolymer having isocyanate groups and an amino group [NHx] in the amines (B). In a formula of the amino group [NHx] herein, x denotes 1 or 2, mainly 2. In case where [NCO]/[NHx] exceeds 2/1 or it is less than 1/2, one per molecular, molecular weight of the urea modified polyester (i) becomes so low that the hot offset resistance deteriorates.

According to the present invention, urethane bonds may be contained together with urea bonds in the polyester modified by the urea bonds or urea modified polyester resin (i). A mole ratio between the urea bond contents and the urethane bond content is normally between 100/0 and 10/90, preferably between 80/20 and 20/80, and more preferably between 60/40 and 30/70. In cases where the mole ratio of the urea bond content is less than 10%, the anti-hot offset property deteriorates.

The urea modified polyester resin (i) according to the present invention is manufactured using a one-shot method or prepolymer method. The weight-average molecular weight of the urea modified polyester resin (i) is normally 10,000 or more, preferably between 20,000 and 10,000,000, and more preferably between 30,000 and 1,000,000. In cases where the weight-average molecular weight is less than 10,000, the anti-hot offset property deteriorates. The number-average molecular weight of the urea-modified polyester is not specifically restricted in cases where the below-described non-modified polyester (ii) is used, and may be of any value that makes it easy to obtain the above weight-average molecular weight. The number*average molecular weight is normally 20,000 or less, preferably between 1,000 and 10,000, and more particularly between 2,000 and 8,000. In cases where the number-average molecular weight exceeds 20,000, the low-temperature fixing property and the gloss property used for a full-color apparatus deteriorate.

(Method for Measuring Weight-Average Molecular Weight)

The weight-average molecular weight can be measured, for example, by gel permeation chromatography as follows: In other words, a column is stabilized in a heat chamber at 40° C. While feeding tetrahydrofuran in the column solvent at a speed of 1 ml per minute at this temperature, the column is injected with 50 to 200 μl of resin tetrahydrofuran sample solution, with the sample concentration between 0.05% and 0.6% by weight adjusted, and the weight is measured. In cases of measuring the molecular weight in the sample, the molecular weight distribution having the sample is calculated according to the relations between various logarithmic values of the calibration curve prepared by monodispersed polystyrene standard samples and count numbers. As the standard polystyrene sample for preparing the calibration curve, used are those made by Pressure Chemical Co., or Tosho Corp., containing the molecular weight of $6\times10^2$, $2.1\times10^2$, $1\times10^2$, $4\times10^2$, $1.75\times10^4$, $1.1\times10^5$, $3.9\times10^5$, $8.6\times10^5$, $2\times10^6$, and $48\times10^6$, preferably the standard polystyrene sample at least with ten points used. As the detector, RI (refractive index) detector can be used.

(Non-Modified Polyester Resin)

According to the present invention, it is possible to contain the urea modified polyester resin (i) as well as a polyester not modified by a urea bond (hereinafter referred to as non-modified polyester resin), (ii) as a toner binder component, together with (i). Using with (i) allows a gloss property to be improved in cases where these resins are used for the low-temperature fixing property and a full-color apparatus.

As (ii), the polyol similar to the polyester component of the (i), and the polycondensation product with the polycarboxylic acid (2) are included, those preferred are the same as those in case of (i). As the non-modified polyester resin (ii), those modified by so-called unmodified polyester as well as those modified by chemical bonds other than the urea bond can be used. It is preferred to use (i) and (ii) that are at least partly compatible in view of the low-temperature fixing property and the anti-hot offset property.

Therefore, polyester component of (i) is preferred to be composed similar to (ii).

A weight ratio between (i) and (ii) in cases containing (ii) is normally between 5/95 and 80/20, preferably between 5/95 and 30/70, more preferably between 5/95 and 25/75, and essentially preferably between 7/93 and 20/80. Under the weight ratio of (i) less than 5%, the anti-hot offset property deteriorates and it is disadvantageous to combine the heat-resistance-storage stability with the low-temperature fixing property.

The peak molecular weight of (i) is normally between 1,000 and 30,000, preferably between 1,500 and 10,000, and more particularly between 2,000 and 8,000.

In case the weight is less than 1,000, the heat-resistant preserving property deteriorates while the low-temperature fixing property deteriorates in case the weight exceeds 3,000. The hydroxyl group value of (ii) is preferably 5 or more, more preferably between 10 and 120, and essentially preferably between 20 and 80. If it is less than 5, it is disadvantageous to effect the heat-resistance/storage stability together with low-temperature fixing property. The acid value of (ii) is normally between 1 and 30, and preferably between 5 and 20. It is prone to be negatively electric in case acid value is given.

(Method for Measuring Hydroxyl Group Value)

Sample (0.5 g) is accurately measured into a 100 ml-volumetric flask, and 5 ml of acetylating reagent is correctly added to it. Thereafter, these are soaked into a bath at 100° C.±5° C. for heating. After 1-2 hours, the flask is taken off the bath and allowed to stand for cooling. Thereafter, the flask is loaded with water and shaken to decompose acetic acid anhydride. Furthermore, the flask is again heated in the bath for 10 minutes or more to effect perfect decomposition, and allowed to stand for cooling. The flask wall is then well washed with organic solvent. Using the electrode, the liquid is potentiometric titirated with N/2 potassium hydrate ethyl alcohol solution to obtain the HO value. This procedure is conducted in accordance with JISK0070-1966.

(Method for Measuring Acid Value)

Acid value measurement is carried out in accordance with a method described in JIS K0070-1992 as follows:

Sample preparation: 0.5 g of toner (0.3 g in acetic acid ethyl soluble components) is added to 120 ml of toluene and stirred for about 10 hours at room temperature of 23° C. and dissolved. Then, 30 ml of ethanol is further added to prepare sample solution.

Measurement instrument: DL-53 Titraor, an automated potentiometric titrator made by Mettler Tredo, Inc.

Electrode employed: DG113-Sc (made by Mettler Tredo, Inc.)

Analysis software: LabX Light Version 1.00.000

Calibration of titrator: Mixed solvent of toluene (120 ml) and ethanol (30 ml)

Measurement temperature: 23° C.

Measuring conditions are as follows:

Stir
Speed [%] 25
Time [s] 15
EQP Titration
Titrant/Sensor
Titrant $CH_3ONa$
Concentration [mol/L] 0.1
Sensor DG115
Unit of measurement mV
Predispensing to Volume
Volume [mL] 1.0
Wait time [s] 0
Titrant Addition Dynamic
de(set) [mV] 8.0
dV(min) [mL] 0.03
DV(max) [mL 0.5
Measure Mode Equilibrium Controlled
dE [mV] 0.5
dt [s] 1.0
t(min) [s] 2.0
t(max) [s] 20.0
Recognition
Threshold 100.0
Steepest jump only No
Range No
Tendency None
Termination
at maximum volume [mL] 10.0
at potential No
at slope No
after number EQPs Yes
n=1
comb. termination conditions No
Evaluation
Procedure Standard
Potential 1 No
Potential 2 No
Stop for reevaluation No The measurement can be calculated by the above-described apparatus, more specifically, the acid value is calculated as follows:

The sample is titrated with pre-standardized alcohol N/10 caustic potash solution, and an acid value is obtained from the consumed amount of the alcohol potash solution according to the following calculation.

$$\text{Acid value}=\text{KOH (ml numbers)}\times N\times 56.1/\text{sample weight (where } N \text{ is a factor for } N/10\text{KOH)}$$

In the present invention, the glass transition point (Tg) of resin as a toner binder is normally between 50° C. and 70° C., and preferably between 55° C. and 65° C. If it is less than 50° C., the heat-resistant preserving property deteriorates while the low-temperature fixing property deteriorates if it exceeds 70° C. According to a dry toner of the present invention, the heat-resistant preserving property shows excellent trends even if a glass transition point is low, in comparison with the publicly known polyester based toner, owing to the co-existence of the urea modified polyester resin (i).

The above Tg is specifically determined by the following procedure.

(Method for Measuring Tg)

As a measuring apparatus, TA-60WS and DSC-60, made by Shimazdu Corporation, are used for measuring Tg with the measuring conditions as shown below.

Measuring Conditions

Sampling container: a sampling pan made of aluminum (with a cover)

Sampling quantity: 5 mg

Reference: a sampling pan made of aluminum (with aluminum 10 mg)

Atmosphere: nitrogen (flow rate 50 ml/min)

Temperature Condition

Starting temperature: 20° C.

Rate of temperature increase: 10° C./min

Finishing temperature: 150° C.

Holding time: Nil

Rate of temperature decrease: 10° C./min
Finishing temperature: 20° C.
Holding time: Nil
Rate of temperature increase: 10° C./min
Finishing temperature: 150° C.

The measured results are analyzed by using data analysis software made by the Shimazdu Corporation (TA-60, 1.52 version). An analysis method starts from specifying a range in ±5° C. at a position as a center indicating the maximum peak to the lowest temperature side in the DrDSC curve, which is a DSC differential curve of the second temperature increase, and applying a peak analysis function of the analysis software to obtain the peak temperature. Next, the maximum endothermic temperature of the DSC curve is obtained in a range between the peak temperature +5° C. and the peak temperature −5° C. by the peak analysis function of the analysis software. The temperature indicated herein corresponds to Tg of the toner.

As a storage elastic modulus of the resin as a toner binder, a temperature (TG') that is 10,000 dyne/cm$^2$ in the measured frequency 20 Hz is normally 100° C. or more, and preferably between 110° C. and 200° C. In cases where the temperature is less than 100° C., the anti-hot offset property deteriorates. As viscosity of the toner binder, a temperature (Tη) that is 1,000 poise in the measured frequency 20 Hz is normally 180° C. or less, and preferably between 90° C. and 160° C. In case the temperature exceeds 180° C., the low-temperature fixing property deteriorates. In other words, TG' is preferred to be higher than Tη in the viewpoint of combining the low-temperature fixing property and the anti-hot offset property. More specifically, the difference between TG' and Tη (TG'−Tη) is preferably 0° C. or more. It is more preferable if it is 10° C. or more, and essentially preferable if it is 20° C. or more. The upper limit of these differences is not particularly limited. The difference between Tη and Tg is preferably between 0° C. and 100° C. in the viewpoint of combining the heat-resistance-storage stability and the low-temperature fixing property. It is more preferable if it is between 10° C. and 90° C., and essentially preferable if it is between 20° C. and 80° C.

[Colorant]

The colorants used as toner components according to the present invention include all public-known dyes and pigments available. Examples of these colorants include the following pigments available: carbon blacks, nigrosine colorants, iron black, naphthol yellow S, Hansa yellow (10G, 5G, G), cadmium yellow, yellow iron oxide, loess, chrome yellow, titan yellow, polyazo yellow, oil yellow, Hansa yellow (GR, A, RN, R), pigment yellow L, bendizine yellow (G, GR), permanent yellow (NCG), Balkan fast yellow (5G, R), tartrazine lake, quinoline yellow lake, Ansrasan yellow BGL, isoindolinone yellow, colcothar, minium, lead vermillion, cadmium red, cadmium mercury red, antimony vermillion, permanent red 4R, pallared, fycell red, pallachrolorthonitro aniline red, rissole-fast scarlet G, brilliant fast scarlet, brilliant calnmin BS, permanent red (F2R, F4R, FRL, FRLL, F4RH), fast scarlet VD, Balkan fast rubin B, brilliant scarlet G, resol rubin GX, permanent red F5R, brilliant calnmin 6B, pigment scarlet 3B, Bordeaux 5B, toluidine maroon, permanent Bordeaux F2K, heliobordeaux BL, Bordeaux 10B, BON maroon light, Bon maroon medium, eosin-lake, rhodamine lake B, rhodamine lake Y, azarin-lake, thioindigo red B, thioindigo maroon, oil red, quinacridone red, pyrazolone red, polyazo red, chrome vermillion, bendizine orange, perione orange, oil orange, cobalt blue, cerrian blue, alkari blue lake, pecock blue lake, victoria blue, non-metal phthalonic cyanine blue, phthalonic cyanine blue, fast sky blue, inanthrene blue (RS, BC), indigo, ultramarine blue, iron blue, anthraquinone blue, fast violet B, methyl violet lake, cobalt purple, mangan purple, dioxane violet, anthraquinone violet, chrome green, zinc green, chrome oxide, pyridiane emerald green, pigment green B, naphthol green B, green gold, ashed green lake, malachite green lake, phthalonic cyanine green, anthraquinone green, oxidized titanium, zinc oxide, litbon, and mixtures with these pigments. The colorant content is normally between 1% by weight and 15% by weight based on the total toner components, and preferably between 3% by weight and 10% by weight.

The colorant used as a toner component according to the present invention can be also used in the form of a master batch preliminarily composited with resin.

According to a manufacture of the master batch or as the binder resin knead with the master batch, these as mentioned below can be used either as an independent product or a mixture of them, in addition to the modified polyester resin and the non-modified polyester resin as already described. They are styrene based copolymers (for example, polymers of styrene and its substituents, such as polystyrene, poly p-chrolostyrene, polyvinyl toluene; styrene-p-chrolostyrene copolymer, styrene-propylene copolymer, styrene-vinyl toluene copolymer, styrene-vinyl naphthalene copolymer, styrene-acrylic acid methyl copolymer, styrene-acrylic acid ethyl copolymer, styrene-acrylic acid butyl copolymer, styrene-acrylic acid octyl copolymer, styrene-methacrylic acid methyl copolymer, styrene-methacrylic acid ethyl copolymer, styrene-methacrylic acid butyl copolymer, styrene-α-chloromethacrylic acid methyl copolymer, styrene-acrylic nitrile copolymer, styrene-vinyl methyl ketone copolymer, styrene-butadiene copolymer, styrene-isoprene copolymer, styrene-acrylic nitrile-indene copolymer, styrene-maleic acid copolymer, styrene-maleic acid ester copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aroma based petroleum resin, chlorinated paraffin, and paraffin wax.

The master batch can be obtained by mixing and kneading resin for master batches and colorants with high shearing power. Organic solvents can be used in order to increase the interaction between the colorant and the resin when the master batch is manufactured. Furthermore, a so-called flashing method is preferably used. It is a method for removing water contents and organic solvent components by means of mixing and kneading colorant aquagenic paste together with the resin and the organic solvent, and transferring the colorant to the resin side. This method is convenient because wet cake in the colorant can be used as it is and it is not necessary to be dried up. A high shearing dispersing apparatus, such as a three-line roller mill is preferably used for mixing and kneading.

(Releasing Agent)

As a releasing agent used as toner components according to the present invention, wax can also be contained. As wax used according to the present invention, those publicly known are used, including polyolefin wax (for example, polyethylene wax, and polypropylene wax); long chain hydrocarbon (for example, paraffin wax, and xazole wax); and carbonyl group contained wax. Among these, it is preferred to use carbonyl group-containing wax. Examples of the carbonyl group-containing wax include polyalkanic acid esters (for example, carnauba wax, montan wax, trimethylol propane tribehenate, pentaerythritol tetrabehenate, pentaerythritol diacetate dibehenate, glycerin tribehenate, 18-octadekane diol destearate); polyalkanol esters (for example, trimelitic acid trisearyl, distearyl maleate); polyalkanic acid amides (for example, ethylene diamine dibehenyl amid); polyalkyl amides (for example, trimelitic acid trisearyl amid); and dialkyl ketones (for example, distearyl alkyl ketone). Among these carbonyl group-containing waxes, it is preferred to use polyalkanic acid esters.

The melting point of the wax used as a toner component according to the present invention is normally between 40° C. and 160° C., preferably between 50° C. and 120° C., and more preferably between 60° C. and 90° C. Wax with its melting point at 40° C. gives adverse effects to the heat-resistance-storage stability, while wax with its melting point at 160° C. or higher easily causes a cold offset at the time of fixiability at low temperatures. The melting viscosity of the wax is preferably between 5 cps and 1,000 cps (5 mPa·s and 100 mPa·s), more preferably between 10 mPa·s and 100 mPa·s (10 mPa·s and 100 mPa·s), and as a value measured at a temperature of 20° C. higher than the melting point. Wax with its melting viscosity exceeding 1,000 cps (1,000 mPa·s) is poor in improvement effects towards the anti-hot offset property and the low-temperature fixing property. The wax content of toner is normally between 0% by weight and 40% by weight, and preferably between 3% by weight and 30% by weight.

(Charge Controlling Agent)

Furthermore, a charge-controlling agent may be contained as a toner component according to the present invention as needed. As the charge controlling agents, those publicly known may be used; examples include nigrosine dyes, triphenylmehanese dyes, chromium content metal complexes dyes, molybdate chelate pigments, rhodamine dyes, alkoxy amines, quaternary ammonium salts (including for example fluorine modified quaternary ammonium salts), alkyl amides, phosphorus or phosphorus compounds, tungusten or tungusten compounds, fluorine surfactants, salicyl acid metal salts, and metal salts of salicylic acid derrivatives.

More specifically, included are as follows; nigrosine dye, Bontron 03; quaternary ammonium salt, Bontron P-51; metallized azo dye, Bontron S-34; oxynaphtoe acid metal complex, E-84; phenolic condensate, E-89 (those made by Orient Chemical Industries, Ltd.); quaternary ammonium salts molybdenum complex, S-34 and TP-415 (those made by Hodogaya Chemical Co., Ltd.); quaternary ammonium salts copy charge, PSY VP2038; triphenylmehanese derivative copy blue, PR; quaternary ammonium salts copy charge, NEG VP 2036; copy charge, NX VP434 (those made by Hoechst GmbH); LRA-901; LR-147 as a horon complex (made by Japan Carlit Co., Ltd.); copper phthalocyanines; perlynes; Quinacridone; azo pigment; and a compound of polymer materials having a sulfon acid group, carboxyl group and functional groups, such as quaternary ammonium salts.

Although the consumed quantity of the above charge controlling agent is not limited in one sense but determined by a type of resin for a binder, the presence of additive agents used as needed, and a method for manufacturing a toner including a dispersion method, the charge controlling agent is used preferably in a range between 0.1 parts by mass and 10 parts by mass per 100 parts by mass of the resin. It is more preferably in a range between 0.2 parts by mass and 5 parts by mass. In case the quantity exceeds 10 parts by mass, toner chargeability is so big that the effects of the main charge control agents are reduced; the electrostatic suction with a toner increases resulting in lower fluidity of developers and a lower image density. These charge controlling agents and releasing agents can be either melt-kneaded together with master batches and resins, and of course these agents may be added to an organic solvent at the time of melting and dispersing.

(Formation of Liquid Droplets in an Aqueous Medium)

Next, the formation of liquid droplets caused by emulsion in the aqueous medium is described.

As described above, in the emulsifying step upon manufacturing of toner according to the present invention, an emulsifying mechanism equipped with an emulsion circulation pathway and an emulsifying device having a stirring blade continuously mixes the oil phase with aqueous phase for emulsification, forming toner-sized liquid droplets. After granulation, the emulsified liquid is fed to the next step by which toner base particles are formed through sequential steps of desolvation, filtration, washing and drying.

Although water may be used alone as the aqueous medium according to the present invention described above, any solvent miscible with water may be used in combination; examples thereof include alcohols (for example, methanol, isopropanol, glycol) dimethylformamide, tetrahydrofran, cellusolves (for example, methyl cellusolve), and lower ketones (for example, acetone, methyl ethyl ketone).

As described above, polyester resins are preferred as a toner binder resin used for toner components, which can be manufactured generally by the following method.

A polyester having a hydroxyl group is obtained by heating the polyol (1) and the polycarboxylic acid (2) at temperatures between 150° C. and 280° C. in the presence of a publicly known esterification catalyst, such as tetrabutoxytitanate or dibutyltin oxide, and as necessary distilling off generated water generated by reducing the pressure. Next, an isocyanate group-containing prepolymer (A) is obtained by reacting the polyester with the polyisocyanate at temperatures between 40° C. and 140° C.

According to the manufacturing method of the present invention, as shown in FIG. 1, two different oil phases are separately prepared in advance: A type oil phase 7 prepared by dissolving or dispersing a non-modified polyester resin, colorant and releasing agent into an organic solvent to produce a dissolved matter or dispersion liquid and by mixing an extender therewith; and B type oil phase 8 prepared by dissolving an isocyanate bond-containing prepolymer (A) in an organic solvent. These oil phases are continuously emulsified while proceeding polymerization reactions in the emulsifying mechanism.

The polymerization reaction yields a polyester modified by the urea bond (modified polyester resin) (i). The polyester not-modified by the urea bond (non-modified polyester resin) (ii) is obtained in the same manner as the above polyester having hydroxyl groups. It should be noted that a solvent can be used when (3) is reacted, and (A) and (B) are reacted together.

Examples of applicable solvents include those inactive to isocyanate (3) such as aromatic agents (for example, toluene, and xylenes), ketones (for example, acetone, methyl ethyl ketone, methyl isopropyl ketone), esters (for example, ethyl acetate), amides (for example, dimethylformamide, dimethylacetoamide) and ethers (for example, tetrahydrofuran).

It is preferred to use volatile organic solvents that (1) reduce the viscosity of the oil phase containing toner components to a level that can effect emulsification, (2) dissolve for example the above-mentioned modified polyester resins (i) and prepolymers (A), and (3) have melting points of less than 100° C. so as to facilitate subsequent removal.

These solvents are below-listed and can be used alone or combined with two or more different types; examples include toluene, xylene, benzene, carbon tetrachloride, ethylene chloride, 1,2-dichloroethane, 1,1,2-trichloroethane, trichloroethylene, chloroform, monochlorobenzene, dichloro ethylidene, methyl acetate, ethyl acetate, methyl ethyl ketone and methyl isobutyl ketone. Particularly preferred are aromatic solvents such as toluene, xylene, and halogenated hydrocarbons such as 1,2-dichloroethane, chloroform and carbon tetrachloride. The toner particle shape can be further adjusted by combining a solvent miscible with aqueous media such as alcohol and water. The added amount of solvent is normally between 10 parts by mass and 90 parts by mass per 100 parts by mass of toner components.

A high-speed shearing type dispersing device is preferably used as an emulsifying device equipped with a stirring blade, which is provided at the emulsifying mechanism that disperses an oil phase into an aqueous medium to prepare emulsion. The user may use any commercially available high-speed shearing type dispersing device; for example, Ebara Milder (made by Ebara Corporation), and TK pipeline Homomixer (made by Tokushu Kika Kogyo KK).

In cases where a high-speed shearing type dispersing device is used, the rotational speed is adjusted such that the stirring Reynolds numbers (stirring Re) and shearing energy (E) at the time of stirring the emulsified liquid are suitable for the above-described conditions of integration of the pine particles.

The rotational speed is, for example, normally between 1,000 rpm and 30,000 rpm, and preferably between 5,000 and 20,000 rpm. The temperature during dispersing is normally between 0° C. and 150° C. (under the applied pressure), and preferably between 10° C. and 98° C. Higher temperatures are preferred because the viscosity of the dispersion composed of modified polyester resin (i) and isocyanate bond-containing prepolymer (A) is so low that dispersing performance enhances.

The amount of aqueous medium used at the time of emulsification in the emulsifying mechanism is normally between 50 parts by mass and 2,000 parts by mass, and preferably between 100 parts by mass and 1,000 parts by mass per 100 parts by mass of toner components in the oil phase containing urea modified ester (i) and prepolymer (A). The state of the dispersed toner components is poor when the added amount of aqueous medium is less than 50 parts by mass, resulting in failure to obtain liquid droplets with predetermined particle diameters. It is not economical in cases exceeding 20,000 parts.

(Solid Fine Particle Dispersing Agent)

A solid fine particle dispersing agent dispersed into an aqueous medium according to the present invention exists as a solid that exhibits poor solubility to water, and is preferably formed of fine particles with an average particle diameter of 0.01 μm to 1 μm. The solid fine particle dispersing agents are of two types: inorganic solid fine particle dispersing agents and organic solid fine particle dispersing agents.

Specific examples of inorganic particles include silicas, aluminas, titanium oxides, barium titanates, titanate magnesium, calcium titanates, strontium titanates, zinc oxides, tin oxides, silica sand, clays, mica, wollastonite, diatomaceous earths, chromium oxides cerium oxide, colcothar, trioxide antimony, magnesium oxide, zirconium oxides, barium sulfates, barium carbonates, calcium carbonates, silicon carbides, and silicon nitrides. It is more preferable to use tricalcium phosphate, calcium carbonates, colloidal titanium dioxide, colloidal silica, and hydroxyapatite. It is particularly preferable to use hydroxyapatite synthesized by means of reacting sodium phosphates and calcium chlorides under basic substance in water.

Examples of organic solid fine particle dispersing agents include microcrystals of low molecular weight organic compounds, polymer materials particles; examples include polystyrenes copolymerized with a carboxyl group-containing monomer such as methacrylic acid, obtained by dispersion polymerization, soap-free emulsion polymerization or suspension polymerization, methacrylates and acrylic copolymers, polycondesation-based resins, such as silicones, benzoguanamine, nylon, or a polymer particle by thermosetting resins.

Although the solid fine particle dispersing agent is dispersed into an aqueous medium in advance as described above, other dispersing agents can be combined in order to adjust the adsorption ability of the solid fine particle dispersing agents to the droplets.

After preparing the fine particle dispersing agent in aqueous medium, inorganic substances soluble to acids, such as tricalcium phosphate salts are partly dissolved with necessary quantities of hydrochloride added in advance. It is preferred to use a quantity of adding acid between 0.01% and 10%, which can completely dissolve inorganic substances, and more preferred to use the quantity between 0.1% and 5%.

In case of using solid fine particle dispersing agents soluble to alkali, such as polymeric microparticles copolymerized with methacrylic acid having carboxyl groups, a necessary quantity of base materials, such as sodium hydroxides and the substances are partly dissolved. It is preferred to use a quantity of adding alkali between 0.01% and 10%, which can completely dissolve inorganic substances, and more preferred to use the quantity between 0.1% and 5%.

Examples of tther dispersing agents added at the time of emulsion as needed include 1) anionic surfactants, such as alkyl benzene sulfonates, alpha olefins sulfonates and phosphates, 2) amine salt type, such as alkylamine salts, amino alcohol fatty acid derivatives, polyamines fatty acid derivatives, imidazoline, 3) quarternary ammonium-salt type positive ion surfactants, such as alkyl trimethyl ammonium salt, dialkyl dimethylammonium salts, alkyls dimethyl benzylammonium salts, pyridinium salt, alkyls isoquinolinium salt, a benzethonium chlorides, 4) nonionic surfactants, such as fatty amides derivatives, a polyhydric alcohols derivatives, and 5) ampholytic surfactants, for example, alanine, dodecyl di(aminoethyl)glycine, di(n-octyl aminoethyl)glycine N-alkyls-N, and N-dimethylammonium bethaine.

Using surfactants having fluoroalkyl groups provides effects with a very small amount used. Anionic surfactants having fluoroalkyl groups is preferably used; examples include fluoroalkyl carboxylic acids with 2 to 10 carbon atoms and metal salts thereof, perfluorooctane sulfonyl glutamate disodium, 3-[omega fluoroalkyl(C6-C11)oxy]-1-alkyl (C3-C4) sulfonic acids sodium, 3-[omega fluoroalkyl (C6-C8)-N-ethyl amino]-1-propanesulfonic acid sodium, fluoroalkyl(C11-C20)carboxylic acid, and its metal salts, perfluoroalkyl carboxylic acid (C7-C13), and its metal salts, perfluoroalkyl(C4-C12) sulfonic acids, and its metal salts, perfluoro octane sulfonate di ethanol amide, N-propyl N-(2 hydroxyl ethyl)perfluorooctane sulfonamide, perfluoroalkyl (C6-C10)sulfonamides propyl trim ethyl ammonium salt, perfluoroalkyl(C6-C10)-N-ethylsulfonyl glycine salt, and mono perfluoroalkyl(C6-C16)ethyl phosphate ester.

As an acting agent having the above mentioned fluoroalkyl groups, commercial materials can be used. For example, these commercial materials are known as the following product names including: Surflon S-111, S-112, and S-113 (made by Asahi Glass), Fluorad FC-93, FC-95, FC-98 and FC-129 (made by Sumitomo 3M), Unidyne DS-101 and DS-102 (made by Daikin Industries), Megaface F-110, F-120, F-113, F-191, F-812, and F-833 (made by Dainippon Ink and Chemicals), Ectop EF-102, 103, 104, 105, 112, 123A, 123B, 306A, 501, 201 and 204 (made by Tohchem Products), Ftergent F-100 and F-150 (made by Neos).

Examples of the cationic surfactants include primary aliphatics, secondary aliphatics having fluoroalkyl groups, or quaternary aliphatics ammonium, such as secondary amine acids and perfluoroalkyl(C6-C10)sulfon amide propyl trimethyl ammonium salts, benzalkonium salts, benzethonium chlorides, pyridinium salts, and imidazolinium salts.

For example, these commercial materials are known as the following product names including: Surflon S-121 (made by Asahi Glass), Fluorad FC-135 (made by Sumitomo 3M), Unidyne DS-202 (made by Daikin Industries), Megafac F-150, F-824 (made by Dainippon Ink and Chemicals), Ectop EF-132 (made by Tohchem Products), and Futergent F-300 (made by Neos).

Stabilization of dispersed liquid droplets may be adjusted by the addition of polymeric protective colloids; examples include acids such as acrylic acid, methacrylic acid, alpha-cyano acrylic acid, alpha-cyano methacrylic acid, itaconic acid, crotonic acid, fumaric acid and maleic acid or maleic anhydride; hydroxyl group-containing (meta)acrylic monomers (for example, acrylic beta-hydroxyethyl methacrylate beta-hydroxyethyl acrylic beta-hydroxyl ciprobyl, methacrylate beta-hydroxypropyl acrylic gamma-hydroxypropyl methacrylate gamma-hydroxypropyl, acrylic 3-chloro 2-hydroxyli ciprobyl, methacrylate 3-chrolo-2 hydroxyl probyl, diethylene glycol mono-acrylic ester, diethylene glycol mono-methacrylic acid ester, glycerin mono-acrylic ester, glycerin monochrome methacrylic acid ester, N-methylol acrylamide, N-methylol, methacrylamide; vinyl alcohol or vinyl alcohol ethers (for example, vinyl methyl ether, vinyl ethyl ether, and vinyl propyl ether); esters of vinyl alcohol and carboxyl group-containing compounds (for example, vinyl acetates, propionate acetates vinyl and butyrate vinyls); acrylamide, methacrylamide, diacetone acrylamide, and methylol compounds thereof; acid chlorides such as acrylic acid chloride and methacrylic acid chloride; homopolymers or copolymers of compounds having nitrogen atoms or heterocyclic ring such as vinyl pyridines, vinyl pyrrolidones, vinylimidazole, ethyleneimine; polyoxyethylenes such as polyoxyethylene, polyoxypropylene, polyoxyethylene alkylamine, polyoxypropylene alkylamine, polyoxyethylene alkylamide, polyoxyethylene nonylphenylether, polyoxyethylene laurylphenylether, polyoxyethylene stearylphenylester, and polyoxyethylene nonylphenylester; and celluloses such as methyl cellulose, hydroxyethylcellulose, and hydroxypropylcellulose.

In case of using a dispersing agent, it can be left on toner surface; however, it is preferred to remove the remaining solid fine particle dispersing agent after elongation and/or cross-linking reactions in view of charging ability of toner.

The emulsified liquid (emulsified dispersion) processed into toner-sized liquid droplets at the above step is fed to the next step. Organic solvents in the emulsifying dispersion are then removed. In order to remove the organic solvents from the emulsifying dispersion, the users can gradually heat up the entire base and employ a method for completely removing the organic solvents in the liquid droplets by evaporation. Alternatively, it is also possible to completely remove non-water soluble organic solvents in the liquid droplets by means of spraying the emulsified dispersion into the dry atmosphere to form fine particles as a toner base together with removing water based dispersing agents by evaporation. As for the dry atmosphere in which emulsifying dispersion is sprayed, the users generally use gases in which air, nitrogen, carbon dioxide, and combustion gas are heated; particularly various airflows heated in higher temperatures than boiling points of the highest boiling point solvents to be used.

Thereby, toner base particles of intended quality can be obtained sufficiently with processing in a short period of time, such as spray driers, belted driers and rotary kilns.

It is possible to protect different particles eliminating from particle surfaces by means of mixing obtained toner base particles after dry-up with different particles, such as parting agent particles, charged controllable particles, super plasticizing particles, and colorant particles together as composite particles, and giving mechanical impacts to the composite particles, so that the composite particles are fixed and merged on the surfaces.

Specific means includes a method for adding impactive force to the mixture by blades rotating at high speeds, and a method for charging and accelerating the mixture into high speed airflow, so that the particles or the composited particles are collided at an appropriate collision plate. The following apparatuses are used: an angmill (made by Hosokawa Micron), I type mill (Nippon Pneumatic Manufacturing) modified into lower pulverizing air pressure, Hybridization system (made by Nara Machinery), Criptron system (made by Kawasaki Heavy Industries), and automatic mortars.

(Method for Manufacturing Dry Toner)

After processing the toner base particles and the different particles in mixture, inorganic fine particles, such as fine particles of hydrophobic silica, may be additionally mixed to the mixture as an external additive in order to prepare a dry toner or developer for increased fluidity, storage stability and transferability.

Mixing of external additive can be achieved using a general mixer for powder, and this is preferably equipped with a jacket that enables internal temperature adjustment. The user may give the external additives whether half way or with a gradual addition in order to change the history of loads to the external additives. Of course, the rotational speed of the mixer, rolling velocity, time and temperature may be changed. The user may initially add strong loads, then relatively weak loads to the external additives, or these sequences may be reversed. Examples of applicable mixer equipment include a V type mixer, a locking mixer, a rediger mixer, a nauter mixer, and Henschell mixer.

Although the following methods are available in order to further adjust the shape of the obtained toner, the present invention is not limited to them, including a method for melting and mixing the toner materials composed of a toner binder, and colorant, then using a hybridizer and mechanofusion and mechanically adjusting the shape of the pulverized toner materials; a so-called spray dry method, a method for dissolving and dispersing toner materials soluble to toner binders, then using a spray dry apparatus and removing the solvent to obtain a spherical toner; and a method for spheronizing toner materials by means of heating the toner materials in an aqueous medium.

(External Additives)

As external additives for assisting fluidity, developability and chargeability of the color particles obtained according to the present invention, inorganic fine particles can be used.

The primary particle diameter of these inorganic particles is preferred to be between 5 mμ and 2 μm, and particularly preferred to be between 5 mμ and 500 mμ. Specific surface area by the BET method is preferred to be between 20 $m^2/g$ and 50 $m^2/g$. The use rate in these inorganic particles is preferred to be between 0.01% by weight and 5% by weight, and particularly preferred to be between 0.01% by weight and 2.0% by weight.

Specific examples of inorganic fine particles include fine particles of silicas, aluminas, titanium oxides, barium titanates, titanate magnesium, calcium strontium, strontium titanates, zinc oxides, tin oxides, silica sand, clays, mica, wollastonite, diatomaceous earths, chromium oxides cerium oxide, colcothar, trioxide antimony, magnesium oxide, zirconium oxides, barium sulfates, barium carbonates, calcium carbonates, silicon carbides, and silicon nitrides. Also included are polymer material particles, for example, polystyrenes, methacrylates, acrylate copolymers, polycondesation-based resins, silicones, benzoguanamine, nylon, and polymers particles made of thermosetting resin, which are prepared by dispersion polymerization, soap-free polymerization or suspension polymerization.

It is possible to improve hydrophobicity and to prevent the flow characteristics and charging characteristics from being deteriorated by surface treatments of fluiders. Examples of preferable surface treatment agents include silane coupling agents, sililating agents, silang coupling agents having fluoridated alkyls, organic titanate based coupling agents, aluminum based coupling agents, silicone oil, and modified silicone oil.

Cleaning property improvers used for removing the developers remained in photoreceptors after transcription and the primary transfer medium include fatty acid metal salts (for example, zinc stearates, calcium stearates, stearate), and polymer particles manufactured by soap-free emulsified polymerization (for example, polymethylmethacrylate particles, polystyrene microparticles). Since particle size distribution of the polymer fine particles is relatively narrow, the volume-average particle diameter is preferred to be between 0.01 μm and 1 μm.

(Carrier for Two-Component Developer)

In case of using a toner obtained according to the present invention for a two-component based developer, the toner may be mixed with a magnetic carrier. The amounts of carrier and toner used in the developer are preferably such that toner is used in an amount of 1 part by weight to 10 parts by weight per 100 percent by weight of the carrier. As for magnetic carriers, those conventionally known in the art can be used, such as iron powders, ferrite powders, magnetite powders and magnetic resins, which have particle diameters of 20 μm to 200 μm.

Examples of carrier coating materials include amino resins, urea-formaldehyde resins, melamine resins, benzoguanamine resins, urea resins, polyamide resins, and epoxy resins. Additional examples include polyvinyl and poly vinylidene resins (e.g., acrylic resins, polymethylmethacrylate resins, polyacrylonitrile resins, polyvinyl acetate resins, polyvinylalcohol resins and polyvinylbutyral resins); polystyrene resins such as styrene acrylics copolymer resins; halogenated olefin resins such as polyvinyl chloride; polyester resins such as polyethylene terephthalate resins and polybutylene terephthalate resins; polycarbonate resins; polyethylene resins; polyvinyl fluoride resins; polyvinylidene fluoride resins; polytrifluoroethylene resins; polyhexafluoropropylene resins; copolymers of vinylidene fluoride and acrylic monomers; copolymers of vinylidene fluoride and vinyl fluoride; fluoroterpolymers such as terpolymers of tetrafluoroethylene, fluoride vinylidene and non-fluorine monomers; and silicone resins.

Furthermore, electric conductive powders may be contained in the coating resin. As the materials of conductive powders, metals, carbon black, titanium oxide, tin oxide and zinc oxide can be used.

The average particle diameter of the above conductive powders is preferably 1 μm or less. If the average particle diameter is greater than 1 μm, it will be difficult to control electric resistance. In addition, the toner according to the present invention can be used either as a one-component magnetic toner using no carrier or as non-magnetic toner.

It is possible to particularly develop faithful latent images and reproduce high quality full color images by means of applying the toner according to the present invention for an image forming method that develops a latent electrostatic image formed on a photoconductor with a toner, transferring and fixing the images developed by the toner onto recording media.

It is also possible to develop faithful latent electrostatic images formed on the photoconductor and reproduce high quality full color images by means of applying the toner according to the present invention as a toner for a process cartridge that integrally supports a photoconductor and at least one unit selected from a charging unit, a developing unit containing therein developer and a cleaning means and that is detachably mounted to an image forming apparatus.

Furthermore, mounting the above described process cartridge onto an image forming apparatus enables image formation with simple maintenance, high reliability and high quality to be provided.

EXAMPLES

The present invention is more specifically described with reference to Examples below, which however shall not be construed as limiting the scope of the present invention. Note that "part" means "part by mass" "%" means "% by mass" unless otherwise indicated.

Example 1

An oil phase (mixture of A-type oil phase and B-type oil phase) and an aqueous phase were mixed by use of a granulating apparatus with the same configuration as described in FIG. 1 of the foregoing embodiment, preparing an emulsified dispersion. The A-type oil phase, the B-type oil phase, and the aqueous phase were respectively prepared and granulated as follows, then toner base particles were obtained by desolvation, filtration, washing and drying.

First, various raw materials were prepared that are necessary for preparing the A-type phase, such as non-modified polyester resin composed of low molecular weight polyester resin, master batch (MB), and ketimine.

<Synthesis of Non-Modified Polyester Composed of Low Molecular Weight Polyester>

A reaction vessel equipped with a cooling tube, stirrer and nitrogen inlet tube was charged with 229 parts of bisphenol A ethylene oxide (2 mol) adduct, 529 parts of bisphenol A propylene oxide (3 mol) adduct, 208 parts of terephthalic acid, 46 parts of adipic acid and 2 parts of dibutyltin oxide, allowing these ingredients to react at 230° C. under normal pressure for 8 hours, followed by further reaction under reduced pressure of 10 mmHg to 15 mmHg for 5 hours. Subsequently, 44 parts of trimelitic dianhydride was placed into the reaction vessel for reaction at 180° C. under normal pressure for 2 hours, yielding non-modified polyester resin 1 composed of low-molecular weight polyester. Non-modified polyester resin 1 had an number-average molecular weight of 2,500, weight-average molecular weight of 6,700, glass transition temperature (Tg) of 43° C. and acid value of 25. It should be noted that non-modified polyester 1 refers to a polyester not modified by urea bond, as defined in the detailed description above.

<Synthesis of Master Batch>

Master batch 1 was obtained by mixing 1200 parts of water, 540 parts of carbon black (Printex35; made by Degussa) and 1200 parts of polyester resin by use of Henschel mixer (made by Mitsui-Mining), and the mixture was kneaded with two rolls at 150° C. for 30 minutes, rolled and cooled, followed by pulverization with a pulverizer. It should be noted that the carbon black had a pH value of 9.5 and DBP oil absorption of 42 ml/100 mg.

<Synthesis of Ketimine>

A reaction vessel was charged with 170 parts of isophorone diamine and 75 parts of methyl ethyl ketone, allowing them to react at 50° C. for 5 hours to yield Ketimine compound 1, which had an amine value of 418. It should be noted that ketimine serves as an extender for an isocyanate group-containing polyester prepolymer in the below-described B-type oil phase.

[Preparation of A-Type Oil Phase (Black)]

A-type oil phase (black) was prepared using non-modified polyester resin 1, master batch 1 and ketimine compound 1 prepared above. A container equipped with a stirrer and thermometer was charged with 378 parts of non-modified polyester resin 1, 110 parts of carnauba wax, 22 parts of CCA (salicyl acid-metal complex E-84; made by Orient Chemical Industries) and 947 parts of ethyl acetate, the container temperature was then raised to 80° C. with stirring. The container was retained at 80° C. for 5 hours and cooled down to 30° C. in 1 hour. The container was then charged with 500 parts of master batch 1 and 500 parts of ethyl acetate, mixing them for 1 hour to yield raw material solution 1, 1,324 parts of which was moved to the first container, and the carbon black and wax were dispersed under the conditions of a feeding liquid speed of 1 kg/hr, a disc circumferential speed of 6 m/se, and 0.5 mm zirconia beads filled at 80 percent volume and with three circulations, using a bead mill (Ultra Visco Mill; made by Imex). Next, 1,324 parts of 65% ethyl acetate solution of non-modified polyester resin 1 was added, giving one circulation with the bead mill under the above described conditions to yield pigment/wax dispersion liquid 1. The solid content concentration (30° C., 30 minutes) of pigment/wax dispersion liquid 1 was 50%. The A-type oil phase (black) 1 was prepared by charging 749 parts of pigment/wax dispersion liquid 1 and 2.9 parts of ketimine compound 1 in a container and by mixing them with Homodisper (made by Tokushu Kika) for 1 minute at 5,000 rpm.

<Synthesis of Isocyanate Group-Containing Polyester Prepolymer>

Next, an isocyanate group-containing polyester prepolymer necessary for preparation of the B-type oil phase was prepared as follows.

A reaction vessel equipped with a cooling tube, stirrer and nitrogen inlet tube was charged with 682 parts of bisphenol A ethylene oxide (2 mol) adduct, 81 parts of bisphenol A propylene oxide 2 mol adduct, 283 parts of terephthalic acid, 22 parts of trimelitic dianhydride and 2 parts of dibutyltin oxide, allowing them to react at 230° C. under normal pressure for 8 hours, followed by further reaction under reduced pressure of 10 mmHg to 15 mmHg for 5 hours to yield intermediate polyester 1, which had a number-average molecular weight of 2,100, weight-average molecular weight of 9,500, glass transition temperature (Tg) of 55° C., acid value of 0.5, and hydroxyl group value of 51.

[Preparation of B-Type Oil Phase]

Next, a reaction vessel equipped with a cooling tube, stirrer and nitrogen inlet tube was charged with 410 parts of intermediate polyester 1 prepared above, 89 parts of isoholon diisocyanate and 500 parts of ethyl acetate, allowing them to react at 100° C. for 5 hours to yield prepolymer 1, which had a free isocyanate content 1.53% and used as B-type oil phase 1.

[Preparation of Aqueous Phase]

Next, an aqueous phase is prepared as follows:

A reaction vessel equipped with a stirrer and thermometer was charged with 683 parts of water, 11 parts of sodium salt of methacrylic acid ethylene oxide adduct (ELEMINOL RS-30; made by Sanyo Chemical Industries), 83 parts of styrene, 83 parts of methacrylic acid, 110 parts of butyl acrylate, 1 part of ammonium persulfate. The ingredients were stirred at 400 rpm for 15 minutes to yield a white emulsion. The container was heated up to an internal temperature of 75° C. to proceed reaction for a further 5 hours, followed by the addition of 30 parts of 1% ammonium persulfate solution and maturation at 75° C. for 5 hours to yield fine particle dispersion liquid 1, an aqueous dispersion liquid of vinyl resin (i.e., copolymer consisting of styrene, methacrylic acid, butyl acrylate and sodium salt of ethylene oxide methacrylate adduct sulfate). The volume-average particle diameter of fine particle dispersion liquid 1 as measured with LA-920 was 105 nm. A portion of fine particle dispersion liquid 1 was dried and the resin component was isolated. The resin component had a glass transition temperature (Tg) of 59° C. and weight-average molecular weight of 150,000. Subsequently, 83 parts of fine particle dispersion liquid 1, 99 parts of water, 37 parts of 48.5% solution in dodecyl difeniyluter disulfonic acid sodium (ELEMINOL MON-7; made by Sanyo Chemical Industries) and 90 parts of ethyl acetate were mixed to obtain a lactescent liquid, which was used as aqueous phase 1.

[Granulation by Emulsification]

Emulsification was conducted by feeding A-type oil phase (black) 1, B-type oil phase 1 and aqueous phase 1 from respective supply tanks shown in FIG. 1 to the emulsifying mechanism. The A-type oil phase 1 and B-type oil phase 1 were mixed in advance by a static mixer (STM) before mixed with the aqueous phase 1. The physical properties of A-type oil phase and emulsifying conditions used for atomization and integration are as follows:

<Emulsifying Conditions>

The solid concentration of the oil phase: 47%,

Viscosity of oil phase: 820 mPa·s

Weight ratio between oil phase and aqueous phase at the time of emulsification: 38/62

Added amount of sodium hydroxide: 200 ppm

Blade circumferential speed: 0.8 m/sec.

These phases are continuously emulsified under the above conditions and granulated into toner-sized liquid droplets, then the emulsified liquid is fed to the next step and the liquid is processed as mentioned below to form toner.

More specifically, the step of removing the organic solvent from the emulsified liquid fed to the next step was conducted as follows: The emulsified liquid was heated up to 45° C. and the organic solvent was removed at a stirring blade circumferential speed of 10.5 m/s and under the atmosphere pressure (191.3 kPa). It took 20 hours for solvent removal. After solvent removal, toner base particles were obtained by filtering, washing and drying of the emulsified liquid.

100 parts of the obtained toner base particles and 0.25 parts of a charging control agent (Bontron E-84: made by Orient Chemical) were placed into a Q type mixer (made by Mitsui Mining) and mixed by conducting 5 cycles of 2 minute-operation followed by 1 minute-suspend, with the circumferential speed of a turbine type blade set at 50 m/sec. Then 0.5 parts of hydrophobic silicas (H2000: made by Clarisant Japan) was added and 5 cycles of 30 second-mixing followed by 1 minute-suspend were conducted, with the circumferential speed of the blade set at 15 m/sec. Then 0.5 parts of hydrophobic silica and 0.5 parts of hydrophobic titanium oxide were added and mixed by Henshel mixer, and coarse particles were removed by a screen mesh having 37 μm opening size to yield a toner (black toner) of Example 1.

Table 1 shows the emulsifying conditions in the above toner manufacture.

Values of the toner base particle diameter (hereinafter referred to as "toner particle diameter"), values of Dv and (Dv/Dn), and evaluation results of thin-line reproducibility are shown in Table 2.

[Evaluation of the Thin-Line Reproducibility]

The toner of Example 1 was evaluated for thin-line reproducibility using a modified intermediate transfer type-commercial color copier (Imagio color 5000: made by Ricoh) in which the fixing oil unit was removed. The evaluation was carried out by printing on 6,000 paper sheets (made by Ricoh) at an image coverage of 7% each. Thin lines of the tenth image and those of 30,000th image in the running operation were compared using an optical microscope at 100× magnification for the loss of lines while referring to a scale sample; the status of thin lines was ranked in 5 grades (1-5), with 5 showing the best condition. The evaluation ranks of 3.5 or greater are levels without problems.

Example 2

Toner base particles were produced as in Example 1 except that the emulsifying conditions in Example 1 were changed to those shown below, followed by preparation of toner of Example 2 as in Example 1.

Emulsifying Conditions of Example 2

Solid concentration of oil phase: 45%

Viscosity of oil phase: 740 mPa·s

Weight ratio between oil phase and aqueous phase at the time of emulsification: 38/62

Added amount of sodium hydroxide: 200 ppm

Blade circumferential speed: 0.8 m/sec.

The emulsifying conditions of Example 2 are shown in Table 1 as in Example 1. Values of the toner base particle diameter, values of Dv and (Dv/Dn), and evaluation results of thin-line reproducibility are shown in Table 2.

Example 3

Toner base particles were produced as in Example 1 except that the emulsifying conditions in Example 1 were changed to those shown below, followed by preparation of toner of Example 3 as in Example 1.

Emulsifying Conditions of Example 3

Solid concentration of oil phase: 49%

Viscosity of oil phase: 960 mPa·s

Weight ratio between oil phase and aqueous phase at the time of emulsification: 38/62

Added amount of sodium hydroxide: 200 ppm

Blade circumferential speed: 0.8 m/sec.

The emulsifying conditions of Example 3 are shown in Table 1 as in Example 1. Values of the toner base particle diameter, values of Dv and (Dv/Dn), and evaluation results of thin-line reproducibility are shown in Table 2.

Example 4

Toner base particles were produced as in Example 1 except that the emulsifying conditions in Example 1 were changed to those shown below, followed by preparation of toner of Example 2 as in Example 1.

Emulsifying Conditions of Example 4

Solid concentration of oil phase: 47%

Viscosity of oil phase: 820 mPa·s

Weight ratio between oil phase and aqueous phase at the time of emulsification: 38/62

Added amount of sodium hydroxide: 400 ppm

Blade circumferential speed: 0.8 m/sec.

The emulsifying conditions of Example 4 are shown in Table 1 as in Example 1. Values of the toner base particle diameter, values of Dv and (Dv/Dn), and evaluation results of thin-line reproducibility are shown in Table 2.

Example 5

Toner base particles were produced as in Example 1 except that the emulsifying conditions in Example 1 were changed to those shown below, followed by preparation of toner of Example 5 as in Example 1.

Emulsifying Conditions of Example 5

Solid concentration of oil phase: 47%

Viscosity of oil phase: 820 mPa·s

Weight ratio between oil phase and aqueous phase at the time of emulsification: 55/45

Added amount of sodium hydroxide: 200 ppm

Blade circumferential speed: 0.8 m/sec.

The emulsifying conditions of Example 5 are shown in Table 1 as in Example 1. Values of the toner base particle diameter, values of Dv and (Dv/Dn), and evaluation results of thin-line reproducibility are shown in Table 2.

Example 6

Toner base particles were produced as in Example 1 except that the emulsifying conditions in Example 1 were changed to those shown below, followed by preparation of toner of Example 6 as in Example 1.

Emulsifying Conditions of Example 5

Solid concentration of oil phase: 47%

Viscosity of oil phase: 820 mPa·s

Weight ratio between oil phase and aqueous phase at the time of emulsification: 38/62

Added amount of sodium hydroxide: 200 ppm

Blade circumferential speed: 1.4 m/sec.

The emulsifying conditions of Example 6 are shown in Table 1 as in Example 1. Values of the toner base particle diameter, values of Dv and (Dv/Dn), and evaluation results of thin-line reproducibility are shown in Table 2.

Example 7

Toner base particles were produced as in Example 1 except that the emulsifying conditions in Example 1 were changed to those shown below, followed by preparation of toner of Example 7 as in Example 1.

Emulsifying Conditions of Example 7

Solid concentration of oil phase: 47%

Viscosity of oil phase: 820 mPa·s

Weight ratio between oil phase and aqueous phase at the time of emulsification: 38/62

Added amount of sodium hydroxide: 0 ppm

Blade circumferential speed: 0.8 m/sec.

The emulsifying conditions of Example 7 are shown in Table 1 as in Example 1. Values of the toner base particle diameter, values of Dv and (Dv/Dn), and evaluation results of thin-line reproducibility are shown in Table 2.

Comparative Example 1

Toner base particles were produced as in Example 1 except that the emulsifying conditions in Example 1 were changed to those shown below, followed by preparation of toner of Comparative Example 1 as in Example 1.

Emulsifying Conditions of Comparative Example 1

Solid concentration of oil phase: 42%

Viscosity of oil phase: 660 mPa·s

Weight ratio between oil phase and aqueous phase at the time of emulsification: 38/62

Added amount of sodium hydroxide: 200 ppm

Blade circumferential speed: 0.8 m/sec.

The emulsifying conditions of Comparative Example 1 are shown in Table 1 as in Example 1. Values of the toner base particle diameter, values of Dv and (Dv/Dn), and evaluation results of thin-line reproducibility are shown in Table 2.

Comparative Example 2

Toner base particles were produced as in Example 1 except that the emulsifying conditions in Example 1 were changed to those shown below, followed by preparation of toner of Comparative Example 2 as in Example 1.

Emulsifying Conditions of Example 7

Solid concentration of oil phase: 51%

Viscosity of oil phase: 1,100 mPa·s

Weight ratio between oil phase and aqueous phase at the time of emulsification: 38/62

Added amount of sodium hydroxide: 200 ppm

Blade circumferential speed: 0.8 m/sec.

The emulsifying conditions of Comparative Example 2 are shown in Table 1 as in Example 1. Values of the toner base particle diameter, values of Dv and (Dv/Dn), and evaluation results of thin-line reproducibility are shown in Table 2.

TABLE 1

| | Oil phase condition | | | Emulsifying condition | | |
|---|---|---|---|---|---|---|
| | Solid content concentration (% by mass) (1) | Viscosity (mPa s) (2) | T (1) × (2) | Weight ratio (oil phase/ aqueous phase) | Added amount of sodium hydroxide (ppm) | Blade Circumferential speed (m/sec) |
| Ex. 1 | 47 | 820 | 38,540 | 38/62 | 200 | 0.8 |
| Ex. 2 | 45 | 740 | 33,300 | 38/62 | 200 | 0.8 |
| Ex. 3 | 49 | 960 | 47,040 | 38/62 | 200 | 0.8 |
| Ex. 4 | 47 | 820 | 38,540 | 38/62 | 400 | 0.8 |
| Ex. 5 | 47 | 820 | 38,540 | 55/45 | 200 | 0.8 |
| Ex. 6 | 47 | 820 | 38,540 | 38/62 | 200 | 1.4 |
| Ex. 7 | 49 | 960 | 47,040 | 38/62 | 0 | 0.8 |
| Comp. Ex. 1 | 42 | 660 | 27,720 | 38/62 | 200 | 0.8 |
| Comp. Ex. 2 | 51 | 1,100 | 56,100 | 38/62 | 200 | 0.8 |

TABLE 2

| | Toner particle diameter | | |
|---|---|---|---|
| | Volume-average particle diameter (Dv) (mm) | Ratio of (Dv) to number-average particle diameter (Dn) | Image evaluation (thin line reproducibility) |
| Ex. 1 | 5.98 | 1.08 | 5.0 |
| Ex. 2 | 6.48 | 1.14 | 4.5 |
| Ex. 3 | 5.56 | 1.18 | 4.0 |
| Ex. 4 | 5.78 | 1.15 | 4.5 |
| Ex. 5 | 7.28 | 1.24 | 3.5 |
| Ex. 6 | 7.05 | 1.23 | 3.5 |
| Ex. 7 | 7.12 | 1.39 | 3.5 |
| Comp. Ex. 1 | 8.37 | 1.42 | 2.0 |
| Comp. Ex. 2 | 4.56 | 1.30 | 2.5 |

The test results of thin-line reproducibility demonstrate that excellent evaluation results can be obtained when Dv, Dv/Dn met respective specified values, and that particle size distributions became better with increasing number of items of the oil phase conditions and emulsifying conditions that fall within the specified ranges; in other words.

The toner manufacturing method of the present invention can be appropriately used as a method for manufacturing a toner to be used for electrophotography, electrostatic recording and electrostatic printing because image formation using the toner obtained according to the present invention enables latent images to be faithfully developed and images with high definition and high quality to be provided.

What is claimed is:

1. A method for manufacturing a toner for developing a latent electrostatic image, comprising:

continuously mixing an oil phase with an aqueous phase to form an emulsified liquid with an emulsifying mechanism having an emulsified liquid circulation pathway and an emulsifying device equipped with a stirring blade;

forming liquid droplets from the emulsified liquid by controlling the equilibrium between atomization and integration of the liquid droplets; and feeding the liquid droplets with stirring to a series of treatments including at least desolvation, filtration, washing and drying;

wherein the oil phase is at least one of a dissolved matter and dispersion in which at least a resin and/or resin precursor, a colorant and a releasing agent are dissolved or dispersed into an organic solvent, wherein a product T of the solid content concentration (% by mass) of the oil phase and viscosity (mPa·s) measured with a rotating viscometer at 25° C., and 6 rpm satisfies 30,000≤T≤50,000, wherein a basic substance is added in the emulsified liquid during the feeding of the liquid droplets with stirring to a series of treatments in an amount of 200 ppm to 400 ppm, and wherein the basic substance is at least one selected from the group consisting of a metal hydroxide, a basic oxide, a tertiary amine, a secondary amine, and a primary amine.

2. The method for manufacturing a toner for developing a latent electrostatic image according to claim 1, wherein the resin or resin precursor is composed of two or more different polymers with different molecular weights.

3. The method for manufacturing a toner for developing a latent electrostatic image according to claim 2, wherein the polymers with different molecular weights are composed of a modified polyester resin modified by a urea bond and a non-modified polyester resin not modified by a urea bond.

4. The method for manufacturing a toner for developing a latent electrostatic image according to claim 1, wherein the aqueous phase is an aqueous medium containing a solid fine particle dispersing agent.

5. The method for manufacturing a toner for developing a latent electrostatic image according to claim 1, wherein the weight ratio between the oil phase and the aqueous phase in the emulsified liquid is between 60:40 and 20:80.

6. The method for manufacturing a toner for developing a latent electrostatic image according to claim 1, wherein a blade circumferential speed during feeding of liquid droplets with stirring to a series of treatment is between 0.4 m/sec and 1 msec.

7. The method for manufacturing a toner for developing a latent electrostatic image according to claim 1, wherein the product T satisfies 35,000≤T≤45,000.

8. The method for manufacturing a toner for developing a latent electrostatic image according to claim 1, wherein the product T satisfies 37,000≤T≤40,000.

9. The method for manufacturing a toner for developing a latent electrostatic image according to claim 1, wherein the weight ratio between the oil phase and the aqueous phase in the emulsified liquid is between 40:60 to 30:70.

10. The method for manufacturing a toner for developing a latent electrostatic image according to claim 1, wherein the toner has an average volume particle diameter (Dv) of 3 μm to 8 μm.

11. The method for manufacturing a toner for developing a latent electrostatic image according to claim 1, wherein the toner has a ratio (Dv/Dn) of the average volume particle diameter to an average number particle diameter (Dn) of 1.05 to 1.25.

12. The method for manufacturing a toner for developing a latent electrostatic image according to claim 1, wherein the emulsifying mechanism is a high-speed shearing type dispersing device equipped with a stirring blade.

13. The method for manufacturing a toner for developing a latent electrostatic image according to claim 12, wherein the dispersing device has a rotational speed of 1,000 to 30,000 rpm.

14. The method for manufacturing a toner for developing a latent electrostatic image according to claim 13, wherein the dispersing device has a rotational speed of 5,000 to 20,000 rpm.

15. The method for manufacturing a toner for developing a latent electrostatic image according to claim 1, wherein the continuous mixing is performed at 0° C. to 150° C.

16. The method for manufacturing a toner for developing a latent electrostatic image according to claim 15, wherein the continuous mixing is performed at 10° C. to 98° C.

17. The method for manufacturing a toner for developing a latent electrostatic image according to claim 1, wherein the basic substance is sodium hydroxide.

* * * * *